US008660446B2

(12) United States Patent
Kakehi

(10) Patent No.: US 8,660,446 B2
(45) Date of Patent: Feb. 25, 2014

(54) IMAGE FORMING APPARATUS

(75) Inventor: Yutaka Kakehi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 286 days.

(21) Appl. No.: 13/283,161

(22) Filed: Oct. 27, 2011

(65) Prior Publication Data

US 2012/0106996 A1 May 3, 2012

(30) Foreign Application Priority Data

Nov. 2, 2010 (JP) ..... 2010-246430

(51) Int. Cl.
*G03G 15/00* (2006.01)

(52) U.S. Cl.
USPC ..... 399/49; 399/399

(58) Field of Classification Search
USPC ..... 399/38, 46, 49, 71, 107, 110, 123, 399/397–399
See application file for complete search history.

(56) References Cited

U.S. PATENT DOCUMENTS 7,949,269 B2 * 5/2011 Takeuchi ..... 399/46

FOREIGN PATENT DOCUMENTS

JP 5-341664 A 12/1993

* cited by examiner

*Primary Examiner* — Hoan Tran
(74) *Attorney, Agent, or Firm* — Canon USA Inc IP Division

(57) ABSTRACT

A blade is configured to come into contact with a belt disposed at a position of a separation suspension roller to remove a patch image. A push-up unit disposed adjacent to the separation suspension roller is configured to push up a surface of the belt to separate a recording member. In this configuration, when a patch image is transferred to a transfer unit, separation of the push-up unit from the belt is carried out prior to timing in which the blade comes into contact with the belt so that the patch image can be removed.

4 Claims, 8 Drawing Sheets

IMAGE FORMING APPARATUS

BACKGROUND OF THE INVENTION

1. Field of the Invention

The present invention relates to an image forming apparatus which transfers a toner image placed on an image carrier onto a recording material using a technology of an electrophotographic apparatus such as a copier or a laser printer. Specifically, the present invention relates to an image forming apparatus which includes a transfer belt for transferring and conveying a recording material.

2. Description of the Related Art

In an electrophotographic apparatus which carries and conveys a recording material using a transfer belt suspended by a plurality of suspension members, there is a configuration using a method of forming a patch image for adjustment on the image carrier to achieve a high quality. However, when the patch image passes through a transfer unit that transfers a toner image from the image carrier onto the recording material, the patch image separates from the image carrier and attaches to the transfer belt. To remove the patch image attached to the transfer belt, it is preferable to bring a cleaning blade into contact with the transfer belt. However, continuous contact of the blade with the transfer belt impairs the durability of the transfer belt. Therefore, to remove the patch image while reducing damage to the durability of the transfer belt, there is a method in which the blade stays away from the transfer belt in a standby state and comes into contact with the transfer belt when the patch image is to be removed.

However, if a contact position at which the blade comes into contact with the transfer belt is away from the transfer unit on the downstream side of the transfer unit, the transfer belt has to move a long distance the toner, which is transferred from the image carrier and attached onto the outer peripheral surface of the transfer belt in the transfer unit. To reduce the moving distance of the toner, the blade preferably contacts the transfer belt at a location where a separation suspension roller suspends the transfer belt.

In the configuration in which a recording material is transferred in an electrostatic manner, the recording material is attracted to the belt during a transfer operation. Accordingly, a separation suspension roller is used to separate the recording material from the belt when the recording material is attracted to the belt.

However, as the types of paper increase, it is difficult to handle this issue only by the separation suspension roller. In other words, particularly it is difficult to separate a recording material when the recording material has a weak stiffness. To solve this problem, Japanese Patent Application Laid-Open No. 5-341664 discusses the configuration in which a roller is provided as a push-up unit capable of moving a transfer sheet between a push-up position and a non-push-up position from the inner side thereof. In this configuration, a recording material is separated in such a manner that a push-up roller pushes up the transfer sheet. On the other hand the transfer sheet is not pushed up while a recording material does not need to be separated.

In a case where such a configuration is applied to a transfer belt, a push-up unit, which locally pushes up the transfer belt during a separation process, is disposed on the upstream side or the downstream side of the separation suspension roller in a conveying direction of a recording material. In the case of using a recording material having a weak stiffness such as a thin paper sheet, the recording material is conveyed in a state where the transfer belt is locally pushed up so that waviness occurs in the recording material, which increases the stiffness of the recording material during the separation process. However, if the push-up unit is disposed on the downstream side from the separation suspension roller, the conveying direction of the separated recording material when the separation suspension roller is used, becomes considerably different from the conveying direction of the separated recording material when the push-up unit is used. In order to reduce the difference in the conveying direction of the separated recording material, the push-up unit is disposed on the upstream side of the separation suspension roller. However, the separation position of the recording material, in a case where the push-up unit is used, is away from the separation suspension roller to the upstream side of the separation suspension roller in the conveying direction of the recording material. As a result, a distance between a guide member which guides the separated recording material and the separation position increases, which is likely to cause a conveying error between the recording material and the guide member. For such a case, in order to suppress the conveying error between the recording material and the guide member, the distance between the separation position and the guide member should not be too long. Therefore, the push-up unit is configured to be disposed near the separation suspension roller.

A patch image for adjustment may be formed sometimes on an image carrier subsequently to a toner image to be transferred onto a recording material that is separated by the push-up unit. The patch image on the image carrier is attached to the transfer belt in the transfer unit.

However, since the blade contact position where the blade for removing the patch image comes into contact with the transfer belt is provided at the separation suspension roller, the blade and the push-up unit are disposed to be adjacent to each other. If the timing in which the blade for removing the patch image comes into contact with the transfer belt is set to be prior to the timing in which the push-up unit retreats from the transfer belt, the contact surface of the blade is affected by a push-up operation so as to wave in the width direction. As a result, the contact of the blade becomes unstable.

SUMMARY OF THE INVENTION

The present invention is directed to an image forming apparatus having the structure in which a blade comes into contact with a belt at the position where a separation suspension roller is provided. The structure can prevent the blade contact from becoming unstable when a push-up unit pushes up the surface of the belt to separate a recording material.

According to an aspect of the present invention, there is provided an image forming apparatus. The image forming apparatus includes an image carrier that carries a toner image, a movable belt member that carries and conveys a recording material, a transfer member that transfers by a transfer unit a toner image formed on the image carrier onto the recording material that is carried and conveyed by the belt member in an electrostatic manner, a push-up unit that pushes up the belt member from an inner surface side of the belt member so that a surface of the belt member protrudes locally in a width direction of the belt member which is disposed on a downstream side from the transfer member in a conveying direction of a recording material, a separating and stretching member that is disposed on the downstream side from the push-up unit in a rotation direction of the belt member and suspends the belt member from the inner surface side thereof to separate the recording material from the belt member, a detection unit that detects a patch image for adjustment, an adjustment unit that controls a toner image forming condition based on a detection result of the detection unit, a blade that comes into contact with or is separated from an outer surface of the belt suspended by the separating and stretching member, an execution unit to execute a first mode operation in which the belt member is pushed up by the push-up unit to separate the recording material from the belt member and/or a second mode operation in which the separating and stretching member separates the recording material from the belt member instead of pushing up the belt member by the push-up unit, and a control unit that controls an operation of the blade such that, during the first mode operation, contact timing in which the blade comes into contact with the belt member follows the timing in which the push-up unit retreats from the belt member, but is prior to the timing in which a patch image reaches the blade.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
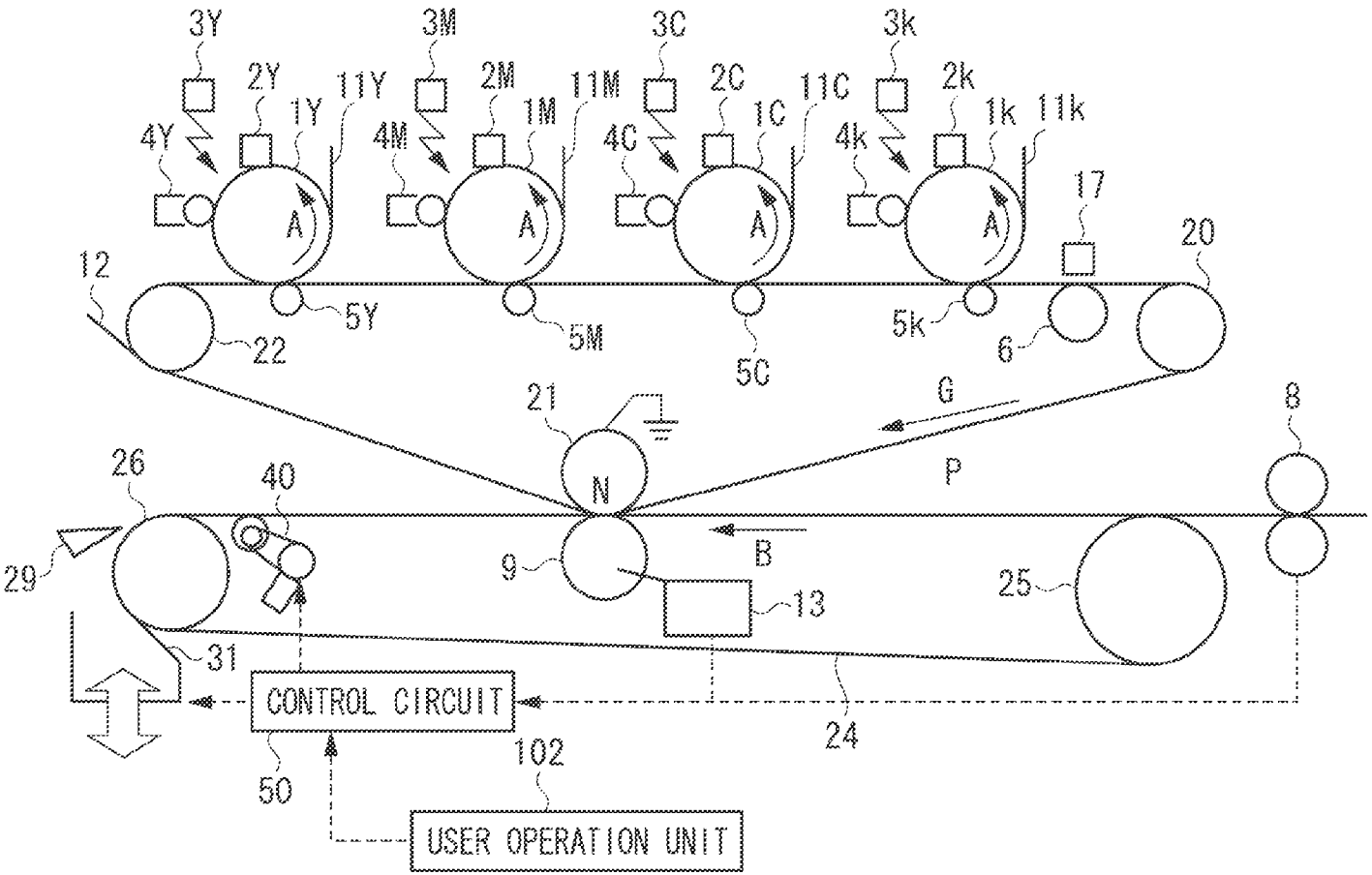
FIG. 1 is a diagram illustrating a basic configuration of an image forming apparatus.

A configuration and an operation of an image forming apparatus according to an exemplary embodiment will be described with reference to FIG. 1.

Photosensitive drums 1Y, 1M, 1C, and 1*k* are driven to rotate in the direction of arrow A. The surfaces of the photosensitive drums are uniformly charged with a predetermined voltage by charging devices 2Y, 2M, 2C, and 2*k*, respectively. The charged surfaces of the photosensitive drums are exposed to light by exposure devices 3Y, 3M, 3C, and 3*k* each using a laser beam scanner so that electrostatic latent images can be formed thereon. The outputs of the laser beam scanners are turned on and off based on image information. In this way, electrostatic latent images corresponding to an image are formed on the respective photosensitive drums. Developing devices 4Y, 4M, 4C, and 4*k* bear chromatic toner of yellow (Y), magenta (M), cyan (C), and black (k), respectively therein. The electrostatic latent images are developed as they pass through these developing devices 4Y, 4M, 4C, and 4*k* when a predetermined voltage is applied to the developing devices, so that toner images are formed on the surfaces of the respective photosensitive drums 1Y, 1M, 1C, and 1*k*. In the present exemplary embodiment, a reversal development system is employed in which development is achieved by attaching toner to an exposed portion of a electrostatic latent image.

The toner images formed on the photosensitive drums 1Y, 1M, 1C, and 1*k* are primarily transferred onto an intermediate transfer belt 6 by primary transfer rollers 5Y, 5M, 5C, and 5*k* which correspond to the toner images, respectively. In this way, four color toner images are transferred on the intermediate transfer belt 6 in a superimposed manner.

The intermediate transfer belt 6 serving as an image carrier is arranged to come into contact with the surfaces of the photosensitive drums 1Y, 1M, 1C, and 1*k*. In addition, the intermediate transfer belt 6 is suspended on suspension rollers 20, 21, and 22 serving as a plurality of suspension members and rotates in the direction of arrow G at a speed of 250 to 300 mm/sec. In the present exemplary embodiment, the suspension roller 20 is a tension roller which controls a tensional force of the intermediate transfer belt 6 to be uniform. The suspension roller 22 is a driving roller for driving the intermediate transfer belt 6.

A transfer belt 24 is a belt member which carries and conveys a recording material, and is suspended between a plurality of suspension rollers 25 and 26 which serve as suspension members. The transfer belt 24 may move in the direction of arrow B at a speed of 250 to 300 mm/sec. The suspension roller 26 serves as a separation suspension roller which separates a recording material. The transfer belt 24, for example, is formed of resin, such as polyimide and polycarbonate, or various kinds of rubber, in which a proper amount of carbon black is contained as an antistatic agent so that the volume resistivity thereof ranges from $1\times10^{9}$ to $1\times10^{14}$ Ω·cm and the thickness thereof ranges from 0.07 to 0.1 mm. In addition, as the transfer belt 24, an elastic member is used which has the value of Young's modulus ranging from 0.5 MPa to 10 MPa measured by tensile strength testing (JIS K 6301).

With the use of the member having the Young's modulus of 0.5 MPa or more measured by the tensile strength testing of the transfer belt 24, the belt can surely maintain the shape while it is driven to rotate. Meanwhile, with the use of the member capable of sufficient elastic deformation and having the Young's modulus value of 10 MPa or less, the waviness of the recording material P occurs effectively through a separation assist device 40 (which will be described below). Therefore, the recording material P can be separated from the transfer belt 24 more effectively. Further, an elastically deformable member which is sufficiently deformable shows a relaxation phenomenon when an amount of deformation is reduced from a deformed state. Therefore, it is possible to reduce the abrasion of the transfer belt 24 caused by the separation assist device 40.

The recording material is stored in a cassette which is not illustrated in the drawing. When a feeding start signal is output, the recording material P is conveyed by a roller (not illustrated) from the cassette in response to the feeding start signal, and is guided to a registration roller 8. The registration roller 8 temporarily stops the recording material P and supplies the recording material P to the transfer belt 24 in synchronization with the conveyance of the toner image on the intermediate transfer belt 6.

On the downstream side from the registration roller 8 in a conveying direction of the recording material (the direction of arrow B), a secondary transfer roller 9 is disposed opposing the suspension roller 21 for suspending the intermediate transfer belt. The secondary transfer roller 9 serves as a transfer member which forms a transfer nip portion N where the toner image is transferred onto the recording material carried by the transfer belt 24. When the recording material is conveyed to the transfer nip portion N, a secondary transfer current with a polarity opposite to the toner is applied to the secondary transfer roller 9. Due to this operation, the toner image on the intermediate transfer belt 6 is collectively transferred onto the recording material P in an electrostatic manner. For example, the present exemplary embodiment applies the current of +30 to +60 μA having a polarity opposite to the toner having a triboelectric charging polarity. The secondary transfer current undergoes a change because a necessary amount of current varies depending on a dry state of the recording material, ambient environments, the amount of toner to be transferred, and the like.

The secondary transfer roller 9 includes a core and an elastic layer of anion conductive foam rubber (NBR rubber). The transfer roller having the following conditions is used: the outer diameter of 24 mm, the roller surface roughness Rz from 6.0 to 12.0 μm, and the resistance value from $1\times10^5$ to $1\times10^7\Omega$ measured with the voltage of 2 kV applied under the condition of N/N (23° C., 50% RH). A secondary transfer high-voltage power supply 13 having a variable supply bias is coupled to the secondary transfer roller 9.

The separation of the recording material is performed by means of the separation assist device 40 described below, or by utilizing the curvature of the separation suspension roller 26 which serves as a separating and stretching member. After the transfer operation, the recording material P separated from the transfer belt 24 is conveyed to a fixing device 60 along a guide surface of the recording material guide 29. Then, the toner image is fixed onto the recording material through a heating and pressuring process. After the fixing operation of the toner image is finished, the recording material P is discharged to the outside of the machine.

In the present exemplary embodiment, to adjust the color of an image, a patch image for adjustment is formed on the intermediate transfer member 6 serving as an image carrier and an image forming condition is adjusted based on the detection result of the patch image. A patch sensor 17 is provided to detect the patch image. The patch sensor 17 is disposed on the downstream side from the photosensitive drum 1*k* but on the upstream side from the suspension roller 20 in the rotation direction of the intermediate transfer belt 6. When the patch images are transferred onto the intermediate transfer belt 6 from the photosensitive drums 1Y, 1M, 1C and 1*k* and reach the patch sensor 17, the patch images are detected by the patch sensor 17. After the patch images are detected, the control circuit 50 serves as an adjusting unit which adjusts the conditions of an image forming unit based on the output of the patch sensor. The image forming unit described herein performs processes from the exposure to the formation of the toner image on the intermediate transfer belt 24 and a process of transferring the toner image from the intermediate transfer belt onto the recording material. In other words, the control circuit 50 adjusts, based on the output of the patch sensor, the outputs of the exposure devices 3Y, 3M, 3C, and 3*k*, an amount of toner which is supplied to each of the developing devices 4Y, 4M, 4C, and 4*k*, or toner image forming conditions such as a developing bias voltage.

The adjusting process is performed during the post-rotation process which follows completion of image forming for the number of print sheets which is specified by a user. In a case where the user enters one as the number of print sheets, a patch image is formed subsequently to the formation of one sheet of image, and then the adjusting process is performed during the post-rotation process. In a case where the user enters a number larger than one as the number of print sheets, the images corresponding to the number entered by the user are successively formed, followed by formation of a patch image, and then the adjusting process is performed during the post-rotation process. In a case where the user inputs 100 or more as the number of print sheets, a patch image is formed between the toner image formed on the 100n-th recording material and the toner image formed on the (100n+1)-th recording material. This is because when the number of print sheets for forming the image increases, there is concern that the color condition of the image may vary. Although the patch image is formed every 100 print sheets according to the present exemplary embodiment, the present invention is not limited to that number. The number of print sheets is set such that color deviation of the image can be prevented.

An intermediate transfer belt blade 12 comes into contact with the intermediate transfer belt to clean the intermediate transfer belt. The patch image passes through a secondary transfer unit and is removed by the intermediate transfer belt blade 12. However, since the patch image comes into contact with the transfer belt 24 without being transferred onto the recording material by the secondary transfer unit, the patch image is partially transferred to the transfer belt 24 at the time of passing through the secondary transfer unit. Since an amount of the patch image toner is 0.3 to 0.6 mg/cm$^2$, if the patch image transferred on the transfer belt 24 is left as it is, the back surface of the recording material is stained.

In the present exemplary embodiment, the patch sensor is provided relative to the intermediate transfer member 6, but the present invention is not limited thereto. The patch sensor may be provided relative to the transfer belt 24. In this case, a suspension member for suspending the transfer belt 24 should be disposed between the secondary transfer roller 9 and the separation assist device 40 in the conveying direction of the recording material and the patch sensor should be disposed at a position facing the suspension member. This is to prevent the detection by the sensor from becoming unstable, which is likely to occur due to waviness of the transfer belt 24 caused by the push-up unit.

In the present exemplary embodiment, a cleaning device 31 is used to remove the patch image on the transfer belt 24. A blade 32 comes into contact with the outer surface of the transfer belt 24 to clean the surface of the transfer belt 24.

The blade 32 comes into contact with the transfer belt and the contact surface is supported by the separation suspension roller 26 from the inner peripheral side thereof. The reason is as follows. In a case where the contact surface of the blade 32 is not supported by the suspension member from the inner peripheral side, there is concern that the blade may be bent on the surface of the flexible belt. In order to prevent the blade from being bent, it is effective to support the belt surface contacting the blade by either the suspension roller or the separation suspension roller from the inner peripheral side.

On the other hand, if a roller, which is away from the transfer unit toward the downstream side in the rotation direction of the belt, is used for supporting the contact surface of the blade from the inner peripheral side, the distance that the transfer belt has to carry the toner, which is transferred from the image carrier in the transfer unit and attached to the outer peripheral surface of the transfer belt, increases. As a result, there is concern that the toner scatters in the interior of the image forming apparatus. For this reason, in order to prevent the toner from scattering, the blade should preferably come into contact with the belt area suspended by the separation suspension roller from the inner peripheral side.

Next, the configuration of the cleaning device will be described in detail with reference to FIG. 4A. A supporting member 101 supports the blade, and a blade swing point 102 serves to support the blade in a swingable manner. The blade is configured to swing about the blade swing point 102 by a driving source (not illustrated) between the position separated from the transfer belt 24 illustrated in FIG. 4B and the position abutting on the transfer belt 24 illustrated in FIG. 4A.

The control circuit 50 serves as a blade control unit which controls the operations of the blade 32. Under control of the control circuit 50, the blade 32 stays at the position separated from the transfer belt 24 in a standby state and comes into contact with the transfer belt 24 in timing when a patch image reaches the blade 32. This is because if the blade 32 is continuously in contact with the transfer belt to clean a patch image, the durability of the transfer belt may be impaired. The control of contact and separation of the blade 32 will be described in detail below.

Figure 2:
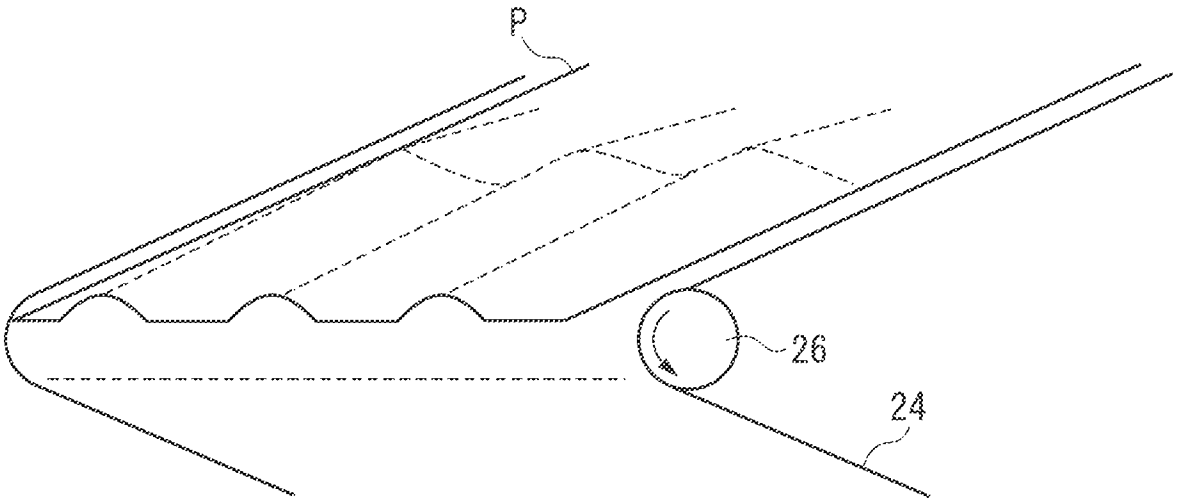
FIG. 2 is a diagram illustrating a transfer belt deformed by a separation assist device.
Figure 3:
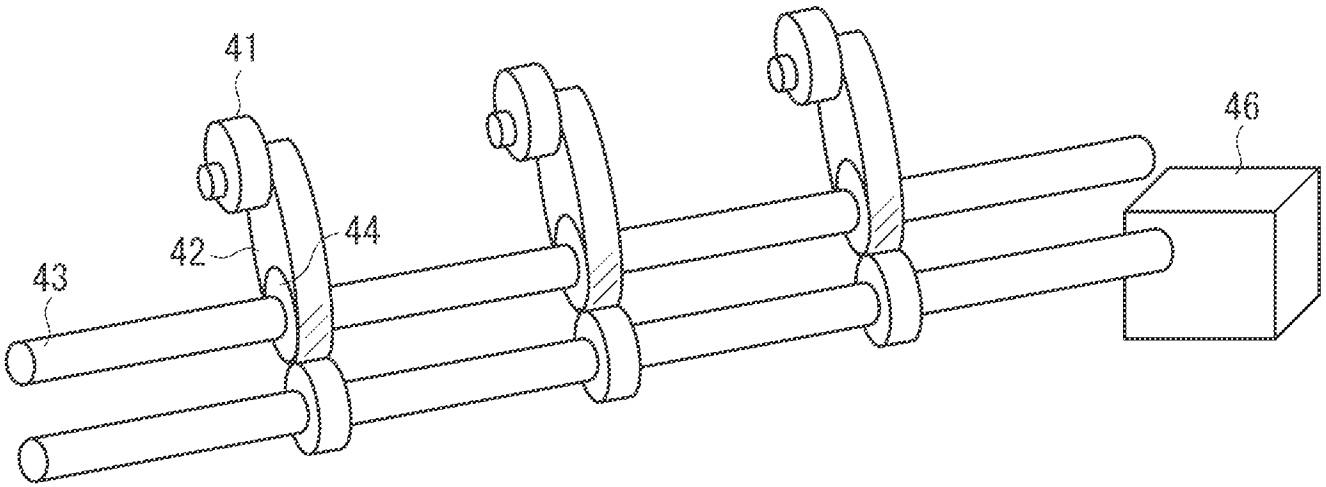
FIG. 3 is a perspective view illustrating the separation assist device.

The separation assist device 40 will be described. FIG. 3 is a perspective view illustrating the separation assist device 40. The separation assist device 40 separates the recording material by deforming the transfer belt 24 which is locally pushed up at a position between the secondary transfer roller 9 and the separation suspension roller 26. FIG. 2 illustrates the state in which the transfer belt 24 is locally pushed up in the width direction by the separation assist device 40. In other words, the separation assist device 40 serves as a unit for locally pushing up the transfer belt 24 in the width direction. The separation assist device 40 is disposed on the downstream side from the secondary transfer roller 9 and on the upstream side from the separation suspension roller 26 in the conveying direction of the recording material.

The transfer belt 24 bends at a position where the transfer belt 24 is in contact with the separation suspension roller 26. When the rigid recording material P such as a thick recording material reaches the bending area where the transfer belt 24 is in contact with the separation suspension roller 26, even though the recording material is not bent in the width direction, the recording material is separated from the transfer belt 24 by the curvature of the bending portion of the transfer belt 24 and the stiffness of the recording material.

Figure 4A:
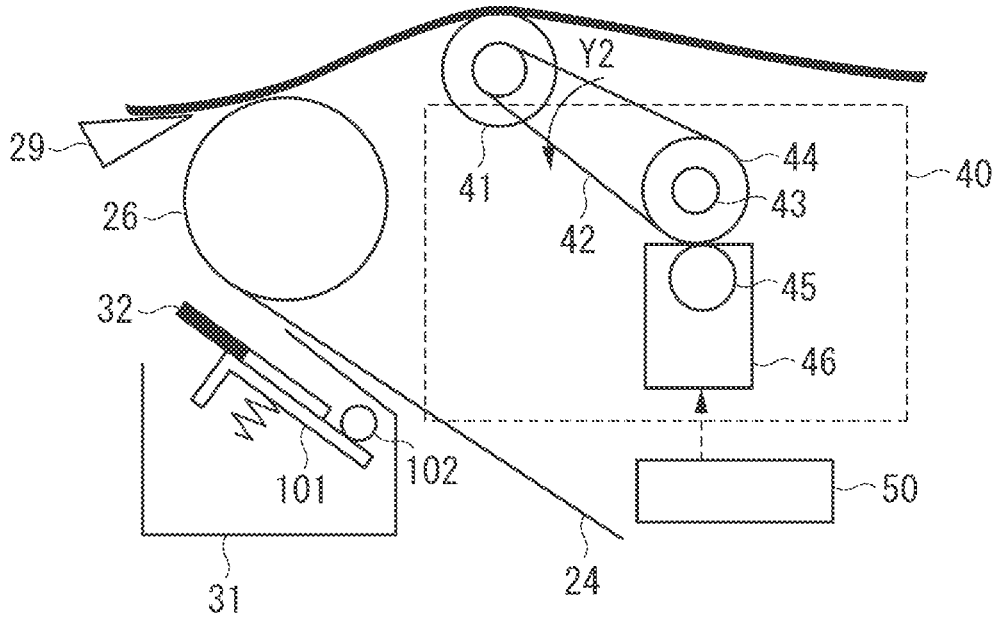
FIGS. 4A and 4B are cross-sectional views illustrating the separation assist device.
Figure 4B:
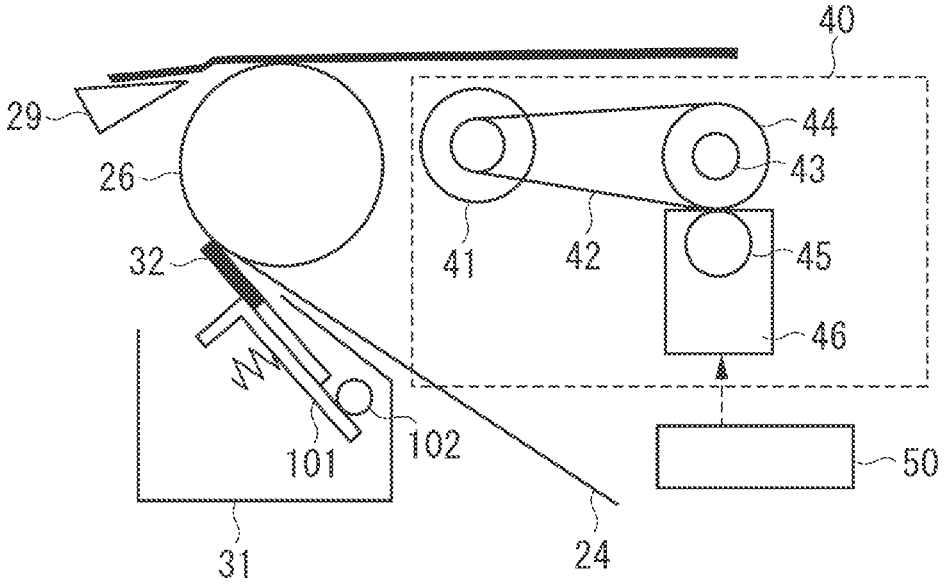

The detailed configuration and operations of the separation assist device 40 are illustrated in FIGS. 4A and 4B. The separation assist device 40 includes a separation assist roller 41 serving as a separation member, a roller frame 42 which supports the separation assist roller 41 which is rotatably driven, and a roller swing center shaft 43 around which the separation assist roller 41 swings. Further, the separation assist device 40 includes a roller driving gear 44 which allows the separation assist roller 41 to swing around the roller swing center shaft 43, a motor driving transmission gear 45 which transmits a driving force to the roller driving gear 44, and a motor 46 which serves as a driving source. The rotation motion of the motor 46 is transmitted to the roller driving gear 44 through the motor driving transmission gear 45. Here, since a bearing member is provided between the roller driving gear 44 and the roller swing center shaft 43, the roller swing center shaft 43 does not receive an influence of the motor 46 which is rotatably driven, so that the location of the roller swing center shaft does not change.

FIG. 4B illustrates the state in which the separation assist roller 41 is separated from the transfer belt 24 and illustrates a retreating position to which the separation assist roller 41 retreats from a push-up position. FIG. 4A illustrates the state in which the separation assist roller 41 comes into contact with the inner surface of the transfer belt 24 to locally push up the transfer belt 24 to the push-up position. The separation assist roller 41 can move from the retreating position illustrated in FIG. 4B to the push-up position illustrated in FIG. 4A in the Y1 direction as the motor 46 rotates forward by a predetermined amount around the roller swing center shaft 43. Further, when the motor 46 rotates backward by a predetermined amount, the separation assist roller 41 moves from the push-up position illustrated in FIG. 4A in the Y2 direction, so that the separation assist roller 41 can move to the retreating position illustrated in FIG. 4B. In other words, the separation assist roller 41 swings as described above by the forward and backward rotations.

The separation assist roller 41 is made of ethylene-propylene rubber (EPDM). The diameter of the separation assist roller 41 ranges 6 to 10 mm and the width thereof ranges 5 to 15 mm. When such a separation assist roller 41 pushes up the transfer belt 24, a local protrusion is formed on the transfer belt 24 in the width direction. Here, the width direction is a direction perpendicular to the moving direction of the surface of the moving belt.

In the state of FIG. 4B, the distance from the separation assist roller 41 to the separation suspension roller 26 ranges from 4 to 8 mm. In the state of FIG. 4A, the separation assist roller 41 pushes up the surface of the transfer belt 24 from the inner surface side such that the surface rises by 3 to 6 mm from the planar state of FIG. 4B.

Since the recording material with a weak stiffness such as a thin paper sheet is easily deformed, waviness is generated in the recording material according to the local deformation of the transfer belt 24 that is generated in the width direction by the push-up operation. As a result, a cross sectional secondary moment of the recording material, that is resistance to tearing, increases. FIG. 2 is a perspective view illustrating a case in which local deformation is generated in the transfer belt in the width direction due to the push-up operation so that waviness is also generated in the recording material. By increasing the stiffness of the recording material, the recording material with weak stiffness such as a thin paper sheet can be effectively separated. Since electrical charges of a polarity opposite to those of the toner are imparted to the inner surface of the transfer belt 24 by the secondary transfer roller 9, the recording material remains attached to the transfer belt 24 after passing through the transfer nip portion N. However, the recording material is separated from the transfer belt 24, due to the separation effect described above, between the protruding peak position at which the transfer belt 24 protrudes and the separation suspension roller 6.

Only one separation assist roller 41 included in the separation assist device 40 may be disposed in the area where the recording material passes through. In this case, however, the wavy range of the recording material in the width direction is narrow. In order to widen the wavy range in the width direction of the recording material, a plurality of the separation assist rollers 41 can be arranged in the width direction in the area where the recording material passes through.

Meanwhile, in a case where a plurality of separation assist rollers 41 is provided, if the separation assist rollers 41 are arranged at a very small interval, the transfer belt 24 is lifted up as a whole, so that a plurality of local protrusions is not formed in the width direction of the transfer belt 24, which may not increase the separation performance. In order to form a plurality of local protrusions in the width direction of the transfer belt, the interval needs to be sufficiently wide.

Accordingly, in the width direction perpendicular to the running direction of the transfer belt 24, the width of the separation assist roller 41 and the interval between the separation assist rollers 41 are set as illustrated in FIG. 3. A length L1 denotes the length of the portion surrounded by the separation assist rollers 41, and a width Wk denotes the width of the separation assist roller 41. A length L2 denotes the length of the portion at the edge surface facing two separation assist rollers 41 adjacent to each other, which can be obtained by L1—2 Wk. In the present exemplary embodiment, the value L2 is set to be 2 Wk or more. In other words, the length in which the separation assist roller 41 does not contact the transfer belt 24 is longer than the length in which the separation assist roller 41 contacts the transfer belt 24. As a result, the transfer belt 24 is not lifted up as a whole but a plurality of portions thereof is protruded in the width direction of the transfer belt 24. Therefore, irregularities may be easily made in the surface of the transfer belt 24.

Figure 5:
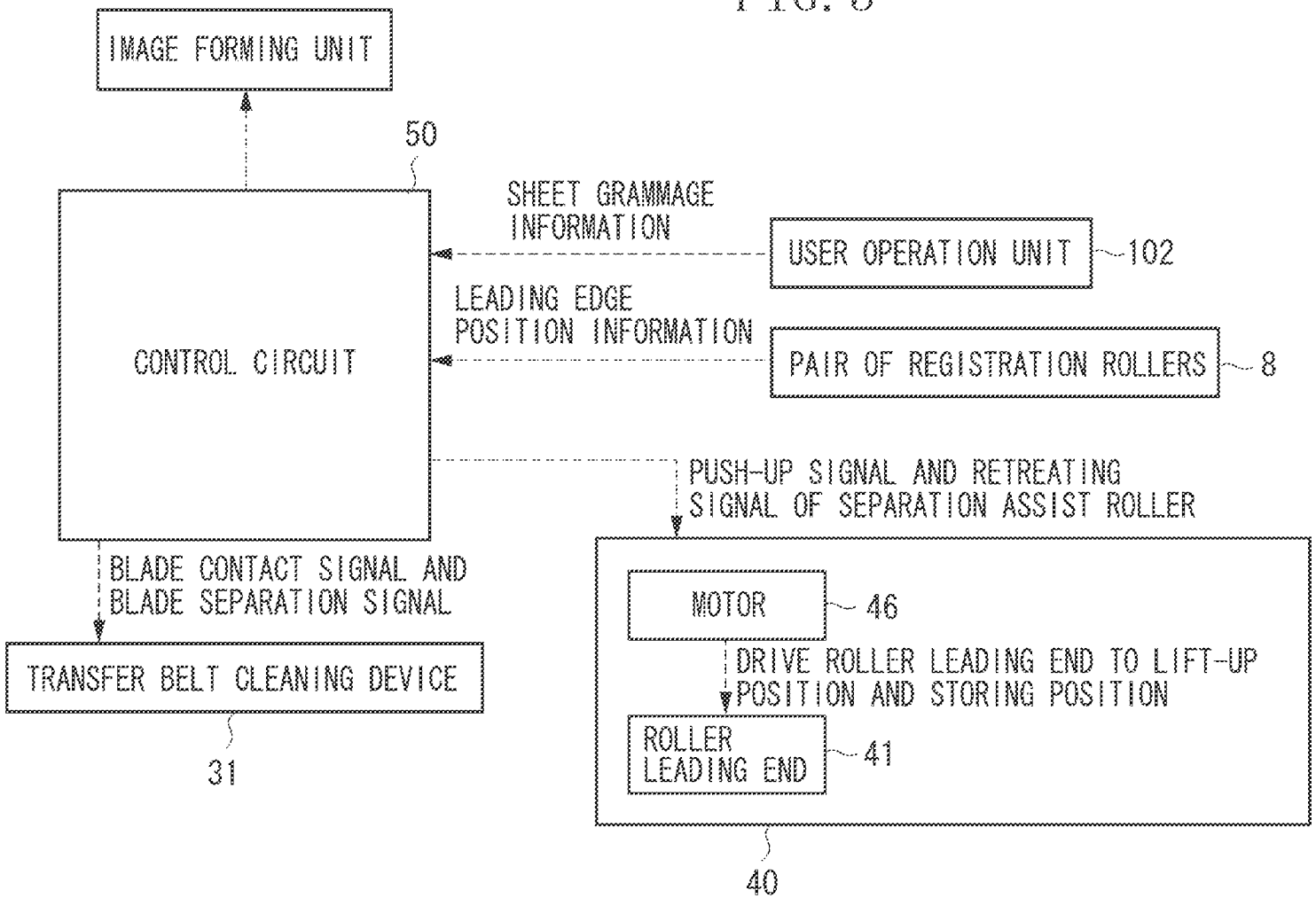
FIG. 5 is a circuit diagram illustrating a control circuit.

The control circuit 50 controls the operational positions of the separation assist device 40. In other words, the control circuit 50 serves as a separation assist device controlling unit which controls the operations of the separation assist device 40. FIG. 5 illustrates the control relation. The operational position signal of the separation assist device 40 is controlled based on the following factors: grammage information of the recording material P which is designated by a user; leading edge position information of the recording material which is obtained based on timing in which a pair of the registration rollers 8 sends the recording material and on the conveying speed of the recording material; and a secondary transfer current value which is read by the secondary transfer high-voltage power supply 13. The control circuit 50 includes a central processing unit (CPU), a read only memory (ROM), and a random access memory (RAM). A user inputs information to the control circuit 50 through a user operation unit 102. The operation timing of the registration roller 8 is input to the control circuit 50. The information of the secondary transfer current value is input to the control circuit 50 from the secondary transfer high-voltage power supply. The control circuit 50 controls the operation of the motor of the separation assist device 40. In addition, the separation assist roller 41 also controls the operation of the cleaning device 31 which cleans the transfer belt, and this operation will be described in detail below.

The grammage is a unit of mass ($g/m^2$) which represents the mass of the product per unit of area. The grammage is generally used as a value representing the thickness of a recording material.

In the present exemplary embodiment, the following two patterns are stored in the ROM in advance.

In a case where the grammage of the recording material is 40 $g/m^2$ or less, the separation assist roller 41 moves to the push-up position to make the transfer belt 24 locally protrude in the width direction.

In a case where the grammage of the recording material is larger than 40 $g/m^2$, the separation assist roller 41 moves to the retreating position. The separation assist roller 41 is separated from the transfer belt 24 at the retreating position.

Namely, two mode operations are performed: in a first mode operation, separation of the recording material is performed by the push-up operation of the separation assist roller 41 when the recording material has a specific grammage (first grammage); and in a second mode operation, separation of the recording material is performed by the curvature of the separation suspension roller 26 instead of the push-up operation of the separation assist roller 41 when the recording material has a second grammage heavier than the first grammage. In this second mode operation, the separation assist roller 41 does not perform the push-up operation on the recording material. In the present exemplary embodiment, two kinds of separation modes can be executed. In other words, the control circuit 50 serves as an execution unit which executes these modes.

The grammage may be input by the user through the operation unit 102. Alternatively, the grammage of the recording material may be input to a storage unit in which the recording materials are stored. In this way, the control circuit 50 determines an operation of the separation assist device 40 based on the information of the grammage which is input to the image forming apparatus.

In the present exemplary embodiment, as described above, the control is performed based on the grammage information input by the user, but the grammage of the recording material may be determined using a sensor which is provided in the image forming apparatus. If the operation of the separation assist device 40 is controlled based on the grammage determined by the sensor, even in a case where a recording material with a relatively small grammage is erroneously accommodated in a cassette that is intended to accommodate a recording material with a relatively large grammage, the push-up operation is carried out. In other words, even when the recording material with a smaller grammage is stored in an erroneous cassette, separation failure of the recording material with a smaller grammage is not likely to occur.

As the sensor, a weight sensor is provided on the conveying path of the recording material to detect the weight of the conveyed recording material. In this case, the grammage of the recording material may be determined based on a weight detected by the weight sensor and size information (area) of the recording material. Alternatively, a transmissive sensor may be provided in the conveying path of the recording material to detect the light transmittance. In this case, the thickness of the recording material may be determined based on the light transmittance of the conveyed recording material.

Figure 6:
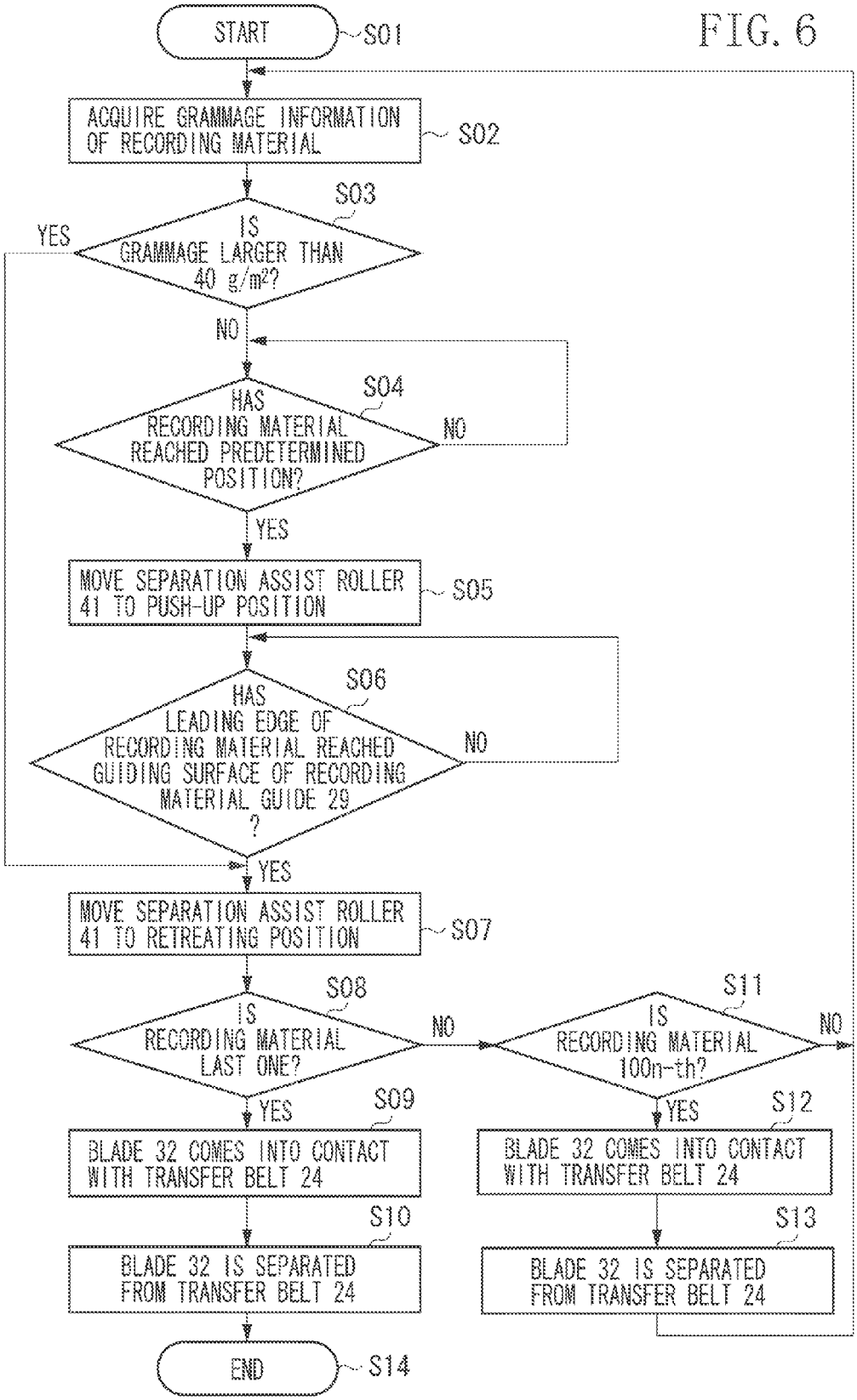
FIG. 6 is a flowchart.

The flowchart of operations for controlling the separation assist device 40 will be described with reference to FIG. 6. When the control starts in step S01, the separation assist device 40 reads grammage information of the recording material which is set by a user through the user operation unit 102 in step S02. In step S03, it is determined whether the grammage read is larger than 40 $g/m^2$. In a case where the grammage of the recording material is determined to be larger than 40 $g/m^2$ in step S03, the separation assist roller 41 is put in the retreating position in step S07. The recording material is separated from the transfer belt 24 using the curvature of the separation suspension roller 26. In a case where the grammage of the recording material P is set to 40 $g/m^2$ or less by the user, to separate the recording material with low stiffness from the transfer belt 24, it is necessary to push up the transfer belt 24 with the separation assist roller 41 to form local protrusions in the transfer belt 24. In a case where the grammage of the recording material P is set to 40 $g/m^2$ or less by the user, it is determined whether the recording material reaches a predetermined position in step S04.

The predetermined position is a position on the upstream side from the separation assist roller 41 in the conveying direction of the recording material and set such that the separation assist roller 41 completes the operation for pushing up the transfer belt 24 before the leading edge of the recording material reaches the position pushed up by the separation assist roller 41. The position of the recording materials detected by using an elapsed time after the recording material passes through the registration roller and a conveying speed of the recording material or by providing a detection member which detects the passage of a recording material.

In a case where the recording material is determined to reach a predetermined position, the separation assist roller 41 moves in the Y1 direction while pushing up the transfer belt 24 and the separation assist roller 41 is put at the push-up position in step S05. On the transfer belt 24 which is deformed by the separation assist roller 41, waves are formed in the recording material P, so that the stiffness of the recording material increases. Accordingly, before the transfer belt 24 reaches the area where the separation suspension roller 26 comes into contact with the transfer belt 24, the recording material P is separated from the transfer belt 24.

Next, it is determined whether the leading edge of the recording material P reaches the guide surface of the recording material guide 29 in step S06. The position of the recording material may be determined by detecting the position based on an elapsed time after the recording material passes through the registration roller, and on a conveying speed of the recording material. Alternatively, the position of the recording material may be determined by providing a detection member which detects the passage of a recording material. In a case where the recording material reaches the guide surface of the recording material guide 29, it is determined that the separation has been performed, and hence the separation assist roller moves to the retreating position in step S07.

Next, it is determined whether the recording material is the last one in step S08. In a case where it is determined that the recording material is the last one, the blade 32 moves to the position at which the transfer belt 24 comes into contact with the blade 32 to remove a patch image in step S09. In a case where the recording material is the last one, the patch image is conveyed to the secondary transfer unit subsequently to conveyance of the recording material. The patch image is partially transferred to the transfer belt 24 in the secondary transfer unit. In order to remove the patch image transferred onto the transfer belt 24, it is necessary to cause the blade 32 to come into contact with the transfer belt 24. If the patch image is removed, the blade 32 is separated from the transfer belt 24, and the process ends in step S14.

In a case where it is determined that the recording material is not the last one in step S08, it is determined whether the recording material is the 100n-th one in step S11. In a case where it is determined that the recording material is not the 100n-th one, the process returns to step S02, and the subsequent steps are performed for the following recording material. In a case where it is determined that the recording material is the 100n-th one, the blade 32 moves to the position at which the transfer belt 24 comes into contact with the blade 32 to remove a patch image in step S12. In a case where the recording material is the 100n-th one, the patch image is transferred to the transfer belt 24 in the secondary transfer unit during a period between conveyance of the 100n-th recording material and the conveyance of the (100n+1)-th recording material. In order to remove the patch image transferred onto the transfer belt 24, it is necessary to cause the blade 32 to come into contact with the transfer belt 24. When the patch image is removed, the blade 32 is separated from the transfer belt 24 in step S13, and the process returns to step S02.

The contact timing and the separation timing of the blade in a case where the grammage of the recording material is larger than 40 g/m$^2$ may be set to be the same as those in a case where the grammage of the recording material is 40 g/m$^2$ or less.

Figure 7:
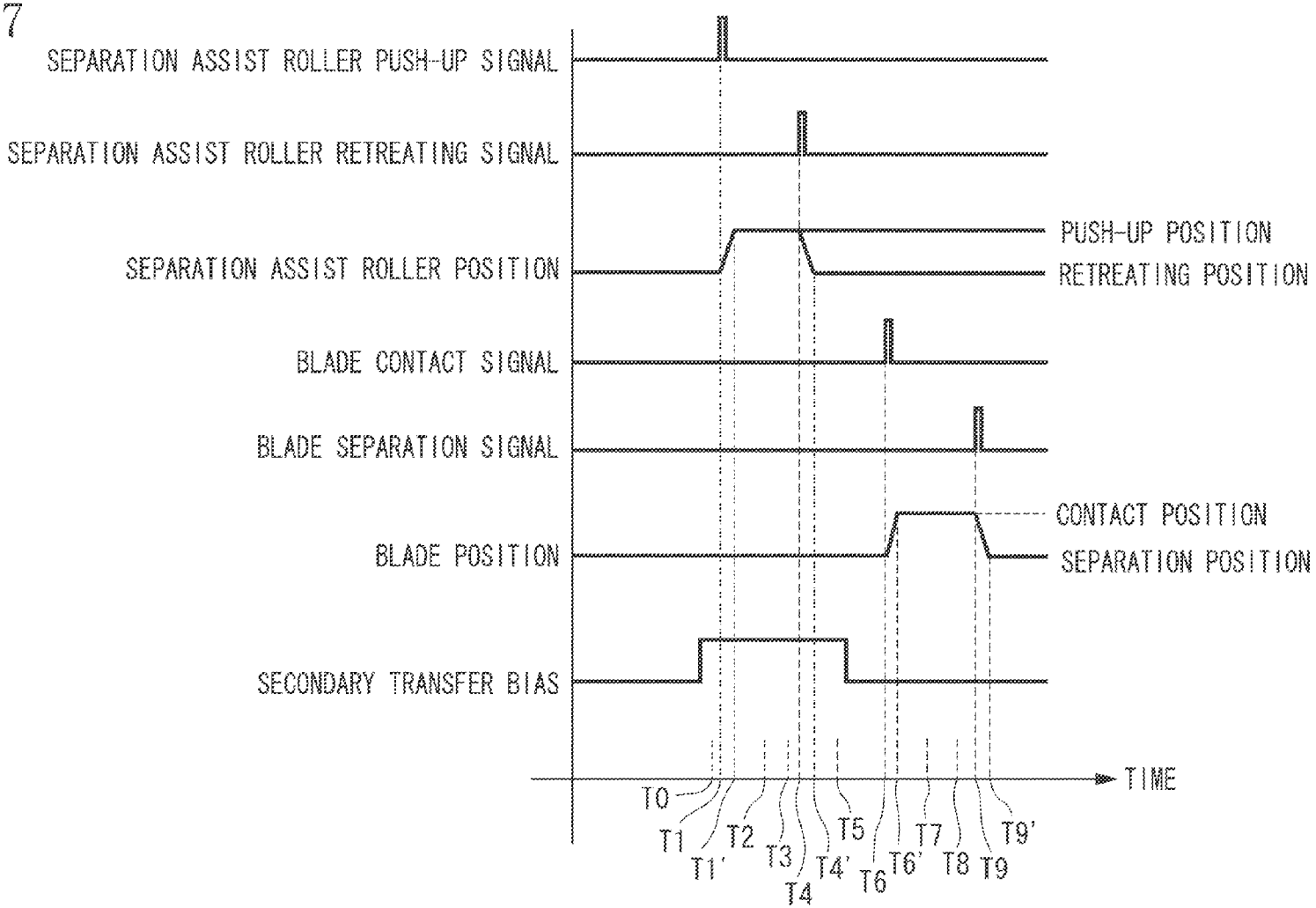
FIG. 7 is a diagram illustrating a time chart when a patch image is formed in a post-rotation process.

In the present exemplary embodiment, a patch image is formed subsequently to the toner image formed on the last recording material, and then the adjustment is performed in the post-rotation process. The operation timing of controlling the separation assist roller 41 will be described with reference to FIG. 7 in a case where the grammage of the last recording material is 40 g/m$^2$ or less.

Since the grammage of the last recording material is 40 g/m$^2$ or less, it is necessary to perform the push-up operation in which the separation assist roller 41 makes the transfer belt 24 move toward the push-up position to separate the last recording material. When the recording material reaches the secondary transfer unit and a toner image is secondly transferred onto the recording material in timing T0, the control circuit 50 sends a roller push-up signal to start the push-up operation of the separation assist roller 41 in timing T1.

The leading edge of the recording material reaches the separation assist roller 41 in timing T2 and the leading edge of the recording material reaches the end portion of the guide surface of the guide 29 in timing T3 after the push-up operation of the separation assist roller 41 is completed in timing T1'. Such a timing sequence is set because, if the leading edge of the recording material reaches the separation assist roller 41 before the push-up operation is completed, the recording material may be hardly deformed, so that the effect of stiffness may be degraded.

After the leading edge of the recording material is determined to reach the end portion of the guide surface of the guide 29, the control circuit 50 sends a roller separation signal to start the retreating operation which moves the separation assist roller 41 to the retreating position in timing T4. Thereafter, when the secondary transfer of a toner image onto the recording material is completed in timing T5, a patch image is conveyed to the secondary transfer unit. Thereafter, the control circuit 50 sends a blade contact signal to start the moving operation of the blade, so that the blade comes into contact with the transfer belt 24 at the contact position for removing the patch image in timing T6.

In the present exemplary embodiment, the roller separation signal is sent such that the timing T4' in which the separation assist roller 41 reaches the retreating position is set to be prior to the timing T6' in which the blade 32 reaches the contact position at which the blade 32 comes into contact with the transfer belt 24. For this purpose, a preset time interval is ensured between the timing T4 in which the roller separation signal is sent and the timing T6 in which the blade contact signal is sent. The reason will be described below.

In the present exemplary embodiment, a patch image is formed during the post-rotation process. In order to operate the image forming apparatus at a high speed, the patch image can be conveyed at an interval as short as possible from the last recording material. However, in a case where the separation of the last recording material is performed by pushing up the transfer belt 24, the transfer belt 24 may remain pushed up at the time when the blade 32 comes into contact with the transfer belt to remove the patch image. However, the separation suspension roller 26 which supports the blade contact area from the inner side of the transfer belt is adjacent to the separation assist device 40 serving as the push-up unit. While the separation assist device 40 serving as the push-up unit pushes up the transfer belt 24, the blade contact area is affected by the push-up operation, so that waves are formed in the blade contact area. As a result, the transfer belt 24 wears irregularly due to the contact with the blade in the width direction, so that there is concern that resistance of the transfer belt 24 becomes uneven in the width direction. For this reason, in the present exemplary embodiment, the timing T4 in which the roller separation signal is sent is set such that the timing in which the separation assist roller 41 reaches the retreating position is prior to the timing T6' in which the blade 32 comes into contact with the transfer belt 24.

In the present exemplary embodiment, the timing T6 in which the blade contact signal is sent is set to follow the timing T5 in which the secondary transfer operation of a toner image is completed onto the recording material. This is because if the blade 32 comes into contact with the transfer belt 24, rotation torque for driving the transfer belt 24 increases, so that the rotation speed of the transfer belt 24 temporarily changes. As a result, if the blade 32 comes into contact with the transfer belt during the secondary transfer of the toner image onto the recording material, there is concern that the toner image is distorted during the secondary transfer. The completion of the secondary transfer onto the recording material is determined according to whether the trailing edge of the toner image to be transferred onto the recording material has passed through the secondary transfer nip portion.

After the blade contact signal is sent in timing T6, the patch image reaches the blade 32 in timing T7. Here, the timing T6 in which the blade contact signal is sent is set such that the timing T6' in which the blade 32 reaches the contact position with the transfer belt 24 is prior to the timing T7 in which the patch image reaches the blade 32. In other words, the control circuit 50 controls the formation conditions of the patch image such that the patch image reaches the blade 32 after the timing in which the blade 32 comes into contact with the transfer belt to ensure the removing of the patch image. The timing T7 in which the patch image reaches the blade 32 is determined based on both of the timing in which the patch image is transferred from the photosensitive drum onto the intermediate transfer belt 6 and the time interval from when the patch image is transferred from the photosensitive drum onto the intermediate transfer belt 6 to when the patch image reaches the blade 32.

Thereafter, if it is determined that the trailing edge of the patch image has passed through the blade 32 in timing T8, the control circuit 50 sends the blade separation signal to start the blade separating operation in which the blade 32 is separated from the transfer belt 24 in timing T9. After that, the blade 32 reaches the separation position to be separated from the transfer belt in timing T9'. Then, the leading edge of the recording material reaches the fixing device 60 and the image forming operation is completed and the rotation of the intermediate transfer belt 6 and the transfer belt 24 is completed.

The contact timing and the separation timing of the blade in a case where the grammage of the recording material is larger than 40 g/m$^2$ may be set to be the same as those in a case where the grammage of the recording material is 40 g/m$^2$ or less. With such setting, the timing is the same as when the grammage of the recording material is 40 g/m$^2$ or less and the separation assist roller 41 is not pushed up.

Figure 8:
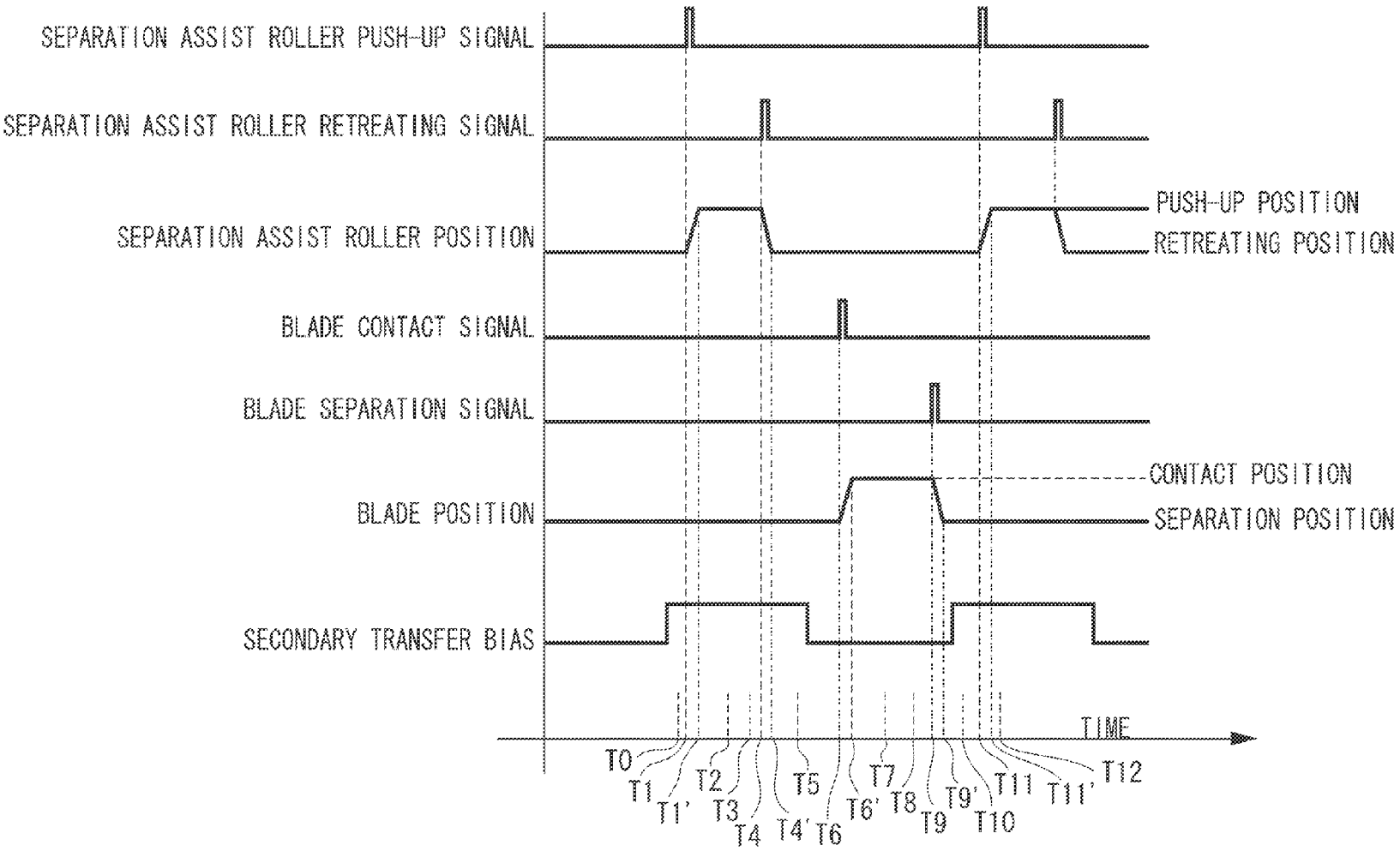
FIG. 8 is a diagram illustrating a time chart when a patch image is formed in the middle of the conveyance of two sheets.

In the present exemplary embodiment, in a case where the user inputs 100 or more as the number of print sheets, a patch image is formed between the toner image to be formed on the 100n-th (n≥1) recording material and the toner image to be formed on the (100n+1)-th recording material. Therefore, the adjustment is performed between the conveyances of these two paper sheets. In other words, the patch image is formed on the intermediate transfer belt subsequently to a specific toner image (first toner image) to be transferred onto the recording material, and then a toner image (second toner image) to be transferred onto the recording material is formed subsequently to the patch image. The operation timing for controlling the separation assist roller 41 in a case where the grammage of the 100n-th and (100n+1)-th recording materials is 40 g/m$^2$ or less will be described with reference to FIG. 8.

Since the grammage of the 100n-th recording material is 40 g/m$^2$ or less, the push-up operation is necessary for the separation assist roller 41. The separation assist roller 41 is pushed up to separate the 100n-th recording material. Subsequently, a patch image is conveyed. The blade 32 comes into contact with the transfer belt in timing T6' and the leading edge of the patch image reaches the blade in timing T7. The operation flow up to timing T7 is performed similarly to when the patch image is formed in the post-rotation process. Thereafter, when the trailing edge of the patch image passes through the position of the blade 32, it is determined that the cleaning operation is completed in timing T8, and the blade separation signal is sent in timing T9.

In a case where the grammage of the (100n+1)-th recording material to be conveyed subsequently to the patch image is 40 g/m$^2$ or less, the push-up operation of the separation assist roller 41 should be performed again to separate the recording material from the transfer belt. After the blade separation signal is sent, the roller push-up signal is sent to separate a following recording material in timing T11. In the present exemplary embodiment, the timing T11 in which the roller push-up signal is sent is set to follow the point of time T9' at which the operation for separating the blade 32 from the transfer belt is completed. Further, the timing T9' in which the operation for separating the blade 32 from the transfer belt is completed is determined based on the timing T9 in which the blade separation signal is sent and on the time interval in which the blade moves from the contact position with the transfer belt 24 to the separation position. Here, the reason will be described below why the timing T11 for sending the roller push-up signal is set to follow the timing T9' in which the blade 32 is separated from the transfer belt and reaches the separation position.

Also in a case where a large number is input as the number of print sheets by the user, it is effective to adjust the image forming conditions by forming the patch image between the conveyances of the paper sheets to suppress the color deviation of the image. However, since the patch image is attached to the transfer belt 24 when the patch image passes through the secondary transfer unit, there is concern that the back surface of the recording material may be stained. In order to remove the attached patch image, it is necessary to perform the contact operation in which the blade 32 comes into contact with the transfer belt 24. However, in order to increase the productivity of the image forming apparatus, the recording materials are preferably conveyed at a short interval.

Accordingly, the recording material is conveyed at a short interval after the patch image. In a case where the grammage of the recording material following the patch image is 40 g/m$^2$ or less, the push-up operation of the separation assist roller 41 needs to be performed again to push up the transfer belt 24. As a result, in a state where the blade 32 is into contact with the transfer belt, the separation assist roller 41 may perform the push-up operation. However, the separation suspension roller 26 which supports the contact surface of the blade 32 from the inner peripheral side is adjacent to the separation assist roller 41. If the transfer belt 24 is pushed up by the separation assist roller 41, the contact surface of the blade 32 is affected by the push-up operation, so that waves are generated in the contact surface. As a result, the transfer belt 24 wears irregularly due to the contact with the blade in the width direction, and thus there is concern that resistance may become uneven in the width direction. Accordingly, in the present exemplary embodiment, the roller push-up signal is sent after the point of time T9' in which the operation for separating the blade 32 from the transfer belt is completed.

In the present exemplary embodiment, the timing T9 for sending the blade separation signal is set such that the timing T9', in which the operation for separating the blade 32 from the transfer belt 24 is completed, is prior to the point of time T10 at which the toner image begins to be secondly transferred to the (100n+1)-th recording material. The reason will be described below. If the blade 32 comes into contact with the transfer belt 24, rotation torque for driving the transfer belt 24 decreases. As a result, the rotation speed of the transfer belt 24 temporarily changes. If the blade 32 is separated from the transfer belt 24 during the secondary transfer operation in which the toner image is transferred onto the recording material, there is concern that the toner image in the secondary transfer operation may be distorted.

Thereafter, the roller push-up signal is sent in timing T11. The operation of pushing up the transfer belt 24 is completed by the separation assist roller 41 in timing T11' and the leading edge of the recording material reaches the separation assist roller 41 in timing T12. After that, when the leading edge of the recording material reaches the end portion of the guide 29, the roller separation signal is sent to separate the roller.

In the present exemplary embodiment, the image forming apparatus is configured such that the timing T6' for removing the patch image in which the blade 32 comes into contact with the transfer belt 24 follows the timing T5 in which the secondary transfer of the toner image onto the recording material is completed, but the present invention is not limited thereto. The image forming apparatus may be configured such that the timing in which the blade 32 comes into contact with the transfer belt 24 is prior to the timing for removing the patch image in which the secondary transfer of the toner image onto the recording material is completed.

In the present exemplary embodiment, when a patch image is formed between the conveyances of two paper sheets, the timing T9 in which the blade separation signal is sent is prior to the timing T10 in which the toner image formed subsequently to the patch image begins to be secondly transferred onto the recording material, but the present invention is not limited thereto. The image forming apparatus may be configured such that the timing for sending the blade separation signal follows the timing in which the toner image formed subsequently to the patch image begins to be secondly transferred onto the recording material.

In the present exemplary embodiment, the timing T1' in which the separation assist roller 41 reaches the push-up position follows the timing TO in which the secondary transfer operation starts. Further, the timing T4' in which the separation assist roller 41 reaches the retreating position from the push-up position is prior to the timing T5 in which the secondary transfer operation is completed. Since such setting reduces the period during which the separation assist roller 41 pushes up the transfer belt 24, it is advantageous in enhancing the durability of the transfer belt 24.

However, the present invention is not limited to the configuration of the present exemplary embodiment. The image forming apparatus may be configured such that the timing in which the separation assist roller 41 reaches the push-up position is prior to the timing of the start of the secondary transfer operation, and such that the timing in which the separation assist roller 41 reaches the retreating position from the push-up position follows the timing of the completion of the secondary transfer operation. The advantage of such a configuration will be described. If the separation assist roller 41 moves from the retreating position to the push-up position, there is concern that the shape of the secondary transfer nip portion may be changed. As a result, if the separation assist roller pushes up the transfer belt during the secondary transfer operation, there is concern that the toner image in the secondary transfer operation may be distorted.

With the setting in which the timing in which the separation assist roller 41 reaches the push-up position is prior to the timing of the start of the secondary transfer operation, the distortion of the toner image during the secondary transfer operation is prevented. The operation in which the separation assist roller 41 retreats from the transfer belt also has the same advantage as described above.

The contact timing and the separation timing of the blade in a case where the grammage of the recording material is larger than 40 g/m$^2$ may be set to the same as those in a case where the grammage of the recording material is 40 g/m$^2$ or less. In this case, the timing is the same as when the separation assist roller 41 is not pushed up in the case where the grammage of the recording material is 40 g/m$^2$ or less.

In the present exemplary embodiment, the patch sensor is disposed to face the intermediate transfer belt 6. However, the patch image sensor may be disposed to face the transfer belt 24. In such an exemplary embodiment, since the patch sensor detects a patch image after the secondary transfer operation, it is necessary to stably transfer the patch image from the intermediate transfer belt 6 to the transfer belt 24. However, in order to remove the patch image, if the timing in which the blade 32 comes into contact with the transfer belt is prior to the timing in which the trailing edge of the patch image passes through the secondary transfer unit, there is concern that the patch image in the secondary transfer operation may be distorted. For this reason, to prevent the patch image from being distorted during the secondary transfer operation, the timing, in which the blade 32 comes into contact with the transfer belt 24 for the purpose of removing the patch image, is preferably set to follow the timing in which the trailing edge of the patch image passes through the secondary transfer unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-246430 filed Nov. 2, 2010, which is hereby incorporated by reference herein in its entirety.

What is claimed is:

1. An image forming apparatus comprising:

an image carrier that carries a toner image;

a movable belt member that carries and conveys a recording material;

a transfer member that transfers by a transfer unit a toner image formed on the image carrier onto the recording material that is carried and conveyed by the belt member in an electrostatic manner;

a push-up unit that pushes up the belt member from an inner surface side of the belt member so that a surface of the belt member protrudes locally in a width direction of the belt member which is disposed on a downstream side from the transfer member in a conveying direction of a recording material;

a separating and stretching member that is disposed on the downstream side from the push-up unit in a rotation direction of the belt member and suspends the belt member from the inner surface side thereof to separate the recording material from the belt member;

a detection unit that detects a patch image for adjustment;

an adjustment unit that controls a toner image forming condition based on a detection result of the detection unit;

a blade that comes into contact with or is separated from an outer surface of the belt suspended by the separating and stretching member;

an execution unit to execute a first mode operation in which the belt member is pushed up by the push-up unit to separate the recording material from the belt member and/or a second mode operation in which the separating and stretching member separates the recording material from the belt member instead of pushing up the belt member by the push-up unit; and a control unit that controls an operation of the blade such that during the first mode operation, a contact timing in which the blade comes into contact with the belt member follows a timing in which the push-up unit retreats from the belt member, but is prior to a timing in which a patch image reaches the blade.

2. The image forming apparatus according to claim 1, wherein in a case where a second toner image to be transferred onto a recording material that is separated in the first mode, is formed subsequently to a patch image, an operation of the push-up unit to push up the belt member is performed after separation timing in which the blade is separated from the belt member.

3. The image forming apparatus according to claim 2, wherein the separation timing is set to be prior to timing in which a leading edge of the second toner image reaches the transfer unit.

4. The image forming apparatus according to claim 1, wherein in a case where a patch image is formed subsequent to a first toner image to be transferred onto a recording material that is separated in the first mode, the contact timing is set to follow a timing in which a trailing edge of the first toner image passes through the transfer unit.

* * * * *